US006393688B1

(12) United States Patent
Axner

(10) Patent No.: US 6,393,688 B1
(45) Date of Patent: May 28, 2002

(54) DE-WIRING APPARATUS

(75) Inventor: Per-Olof Axner, Sundsvall (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/509,884

(22) PCT Filed: Oct. 5, 1998

(86) PCT No.: PCT/SE98/01787

§ 371 (c)(1),
(2), (4) Date: Jun. 26, 2000

(87) PCT Pub. No.: WO99/17993

PCT Pub. Date: Apr. 15, 1999

(30) Foreign Application Priority Data

Oct. 3, 1997 (SE) ..... 9703609

(51) Int. Cl.[7] ..... B23P 19/00; B26D 9/00; B65B 69/00

(52) U.S. Cl. ..... 29/564.3; 29/426.4; 83/509

(58) Field of Search ..... 29/564.3, 426.3, 29/426.4, 33 R, 33 F; 140/149; 83/909

(56) References Cited

U.S. PATENT DOCUMENTS

| | | | | |
|---|---|---|---|---|
| 4,850,087 A | | 7/1989 | Gronau | 29/33 R |
| 5,052,098 A | * | 10/1991 | Thumm | 29/564.3 |
| 5,131,135 A | * | 7/1992 | Gronau | 29/564.3 |
| 5,318,399 A | | 6/1994 | Marom | 414/412 |
| 5,680,691 A | * | 10/1997 | Marom et al. | 29/564.3 |

FOREIGN PATENT DOCUMENTS

| | | | | |
|---|---|---|---|---|
| CA | 1313991 | | 3/1993 | |
| EP | 0 004 923 | | 10/1979 | |
| GB | 2184704 | * | 7/1987 | 29/564.3 |
| SE | 467 822 B | | 9/1992 | |
| SE | 506 077 C2 | | 11/1997 | |
| WO | 91/01919 | | 2/1991 | |
| WO | 91/12995 | | 9/1991 | |

* cited by examiner

*Primary Examiner*—William Briggs
(74) *Attorney, Agent, or Firm*—Lerner, David, Littenberg, Krumholz & Mentlik, LLP

(57) ABSTRACT

Methods and apparatus are disclosed for de-wiring bales tied by metal wires. The method includes moving the bales along a conveyor, stopping movement of the bales and clamping opposite sides of the bales between a pair of clamping units moving perpendicularly to the direction of the conveyor to clamp the opposite sides of the bales therebetween, cutting the metal wires on one side of the bales by means of a cutting tool forming part of one of the clamping units, seizing the metal wires on the other side of the bales and winding up the seized metal wires by means of a gripping and winding tool forming part of the other clamping unit, and discharging the wound-up metal wires from the gripping and winding tool.

2 Claims, 5 Drawing Sheets

DE-WIRING APPARATUS

FIELD OF THE INVENTION

The present invention relates to a method of de-wiring paper bales, and/or pulp bales, each one of which is tied up by metal wires, and the bales being intended to pass a de-wiring apparatus by transport on a conveyor. More particularly, the present invention relates to a de-wiring apparatus for carrying out such a method.

BACKGROUND OF THE INVENTION

A great many solutions are already known with respect to this technique. An example of one such solution is shown and described in U.S. Pat. No. 4,850,087.

This patent discloses two plate-formed holders, positioned at an angular distance of 90° from each other, against which the bale is intended to rest. Each holder has a cutting tool, a separate gripping tool, and a winding tool. There are, however, several drawbacks connected with this device. Firstly, the device becomes very expensive by having so many different tools. Secondly, the efficiency suffers because the three different tools, with different functions, are positioned on one and the same holder. Therefore, there have been requirements in the market for a de-wiring apparatus, which cuts off the wire as well as removes the same from the bale in an effective manner.

The present invention intends to satisfy these requirements and provide a new de-wiring apparatus, which makes possible an effective cutting-off procedure for the wires as well as an effective removal of the same.

SUMMARY OF THE INVENTION

In accordance with the present invention, this and other objects have been realized by the invention of a method for dewiring bales tied by metal wires, the method comprising moving the bales along a conveyor in a first direction, stopping the movement of the bales and clamping opposite sides of the bales between first and second clamping units moving perpendicularly to the first direction so as to clamp the opposite sides of the bales therebetween, cutting the metal wires on one of the sides of the bales by means of a cutting tool forming part of the first clamping unit, seizing the metal wires on the other of the sides of the bales and winding up the seized metal wires by means of a gripping and winding tool forming part of the second clamping unit, and discharging the wound up metal wires from the gripping and winding tool.

In accordance with the present invention, this and other objects have also been realized by the invention of apparatus for dewiring bales having a pair of opposite sides tied by metal wires and moving along a conveyor in a first direction, the apparatus comprising a first movable unit movable in a direction substantially perpendicular to the first direction on one of the sides of the bales, the first movable unit including a cutting tool for cutting the metal wires on the one of the sides of the bales, a second movable unit movable in a direction substantially perpendicular to the first direction on the other of the sides of the bales, the second movable unit including a gripping and winding tool disposed substantially parallel with the conveyor for gripping the metal wires and winding the metal wires, the gripping and winding tool adapted to rotate in order to wind up the metal wires onto bobbins, the second movable unit further comprising a discharging member movable at a location adjacent to the gripping and winding tool distal from the bales for removing the wire wound on the bobbins from the second movable tool.

In accordance with a preferred embodiment of the apparatus of the present invention, the cutting tool comprises first and second strips, each including a plurality of teeth directed towards each other, the first and second strips being movable relative to each other for cutting the metal wires. Preferably, the first and second strips are in contact with each other and in overlapping relationship.

In accordance with another embodiment of the apparatus of the present invention, the gripping and winding tool comprises a substantially cylindrical metal rod rotatably mounted on the second movable unit and including a front end, a rear end, a surface, and a longitudinal direction, a plurality of slots arranged in parallel on the surface of the rod essentially perpendicular to the longitudinal direction of the rod, a longitudinal recess substantially along the entire length of the rod through the plurality of slots, the longitudinal recess thereby providing a first plurality of teeth facing towards the rear end of the rod, and a metal strip disposed in the longitudinal recess and including a second plurality of teeth facing the forward end of the rod so as to be directed in a direction opposite to the first plurality of teeth, the first and second pluralities of teeth being displaceably mounted with respect to the longitudinal recess and being cooperable for gripping the metal wires therebetween.

In accordance with another embodiment of the apparatus of the present invention, the gripping and winding tool comprises a first substantially cylindrical tubular member having a forward end, a rear end, a surface, an inner cavity, and a longitudinal direction, the first substantially cylindrical tubular member being rotatably mounted at the rear end of the first substantially cylindrical tubular member, the first substantially cylindrical tubular member further including a plurality of slots arranged in parallel on the surface of the first substantially cylindrical tubular member essentially perpendicular to the longitudinal direction, the plurality of slots penetrating into the inner cavity of the first substantially cylindrical tubular member, a longitudinal recess substantially along the entire length of the first substantially cylindrical tubular member through the plurality of slots, the longitudinal recess thereby providing a first plurality of teeth facing towards the rear end of the first substantially cylindrical tubular member, and a second substantially cylindrical tubular member displaceably disposed within the first substantially cylindrical tubular member, the second substantially cylindrical tubular member including a strip extending along the entire length of the second substantially cylindrical tubular member, the strip adapted to be positioned in the longitudinal recess of the first substantially cylindrical tubular member, and including a second plurality of teeth facing the forward end of the first substantially cylindrical tubular member so as to be directed in a direction opposite to the first plurality of teeth, the first and second pluralities of teeth being cooperable for gripping the metal wires therebetween.

BRIEF DESCRIPTION OF THE DRAWINGS

The present invention may be more fully appreciated with reference to the following detailed description which, in turn, refers to the Figures, in which.

DETAILED DESCRIPTION

The de-wiring apparatus for bales according to the present invention, which is intended to cooperate with a conveyor 1 for the bale comprises two units, 2 and 3, which are movably arranged towards and away from each other on a frame, this movement being essentially perpendicular to the conveyor 1. In this connection unit 2 is arranged on one side of the conveyor and unit 3 on the other side of the conveyor.

Figure 3:
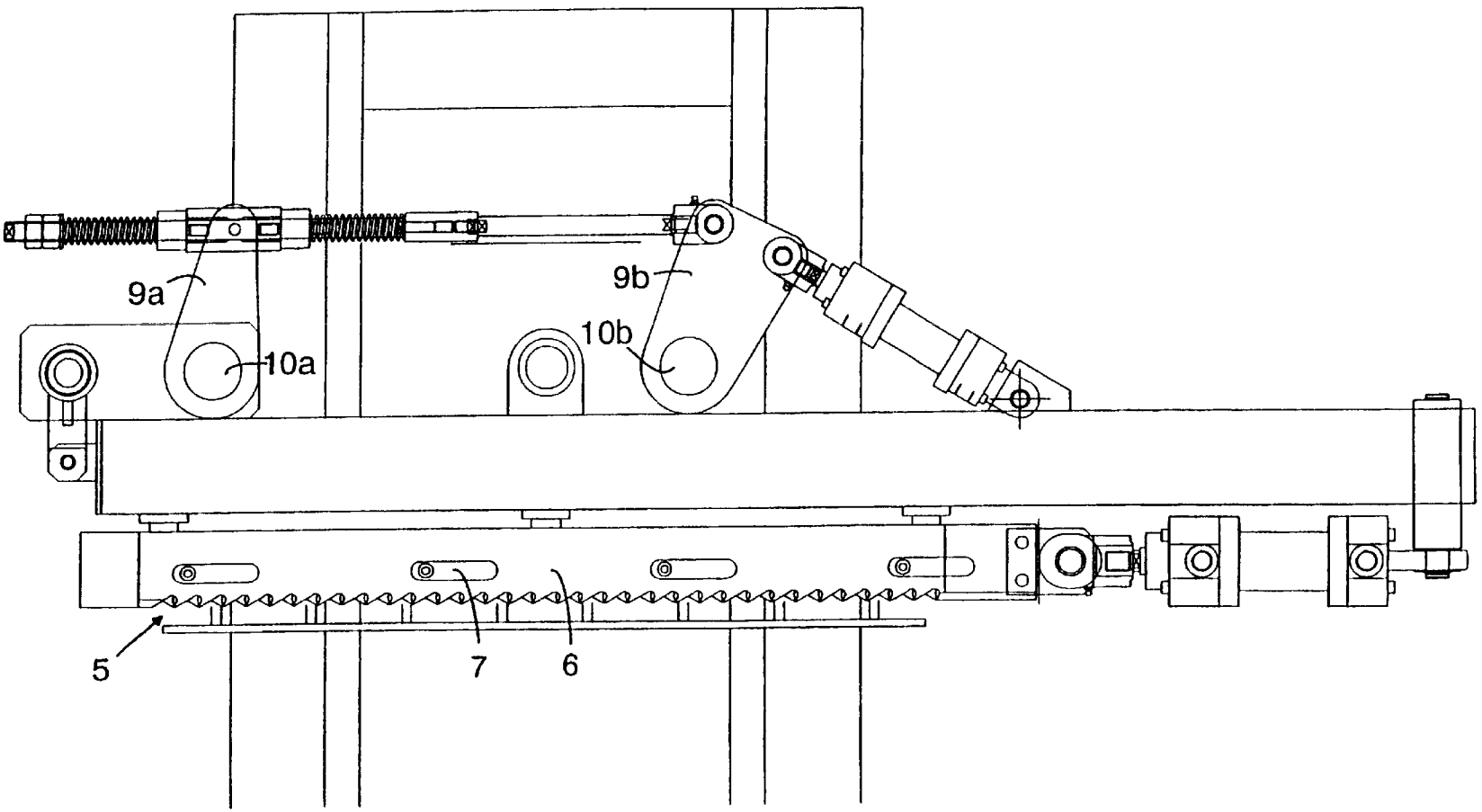
FIG. 3 is a top, elevational, enlarged view of a portion of the apparatus shown in FIG. 2.

The first unit 2 comprises a cutting tool 5 for the wires (see FIG. 3). This tool comprises two strips, 6 and 7, provided with teeth, which are directed towards each other, the rails being positioned one above the other and in contact with each other. Thus, in order for the cutting-off procedure to be effective, the lower strip 7 is movable in relation to the upper strip, and this movement is preferably effected in a hydraulic manner.

As has been mentioned previously the first unit 2, and thus the cutting tool 5, arranged thereon, is movable on the frame 4. This is made possible by the fact that the unit comprises a carriage 8, which is movable in the frame 4 and which can move hydraulically to and fro on the frame 4. Thus, when cutting off the wires, the first unit 2 is forced in the direction towards the conveyor 1 so that the cutting tool is applied against the side surface of the bale. In order to completely ensure that the teeth of the cutting tool seize the wires for cutting off same, the cutting tool itself is provided with arms, 9*a* and *b,* and joints, 10*a* and *b,* which can hydraulically take the cutting tool a short way forwards, and accordingly press the teeth of the two strips, 6 and 7, into the bale itself.

The second unit 3 comprises a combined gripping and winding tool 11 (see FIGS. 4 and 5), which comprises a rotatable, essentially circular-cylindrical metal rod 12, which is rotatably journalled at its rear part and has an extension, which is essentially parallel with the conveyor. On a portion of the jacketed surface of the rod there are provided a considerable number of slots 13, which are arranged in parallel and located along the entire rod, extending essentially perpendicularly to the longitudinal direction of the rod 12. Furthermore, a longitudinal recess 14 is provided straight through the slots and a short way into the rod, and this recess extends essentially along the entire rod. Due to this recess of the rod, teeth are formed thereon, which are designed so that they are directed towards the rear part of the rod 12.

Projecting into the mentioned recess 14 is a metal strip 16, which is provided with teeth, and which is intended to be inserted into the recess, this strip being intended to be displaced hydraulically in relation to the rod 12. Furthermore, the teeth 17 of the strip 16 are directed forwards, i.e. towards the front part of the rod. When displacing the strip 16 in relation to the rod 12 in the direction towards the front part of the rod, the metal wire is taken further into the tooth gap 18 of the tooth 17 and is fixed there by clamping by the teeth 15 of the metal rod.

The second unit 3 is, in the same manner as the first unit, arranged on a carriage 19, which is hydraulically movably arranged in the direction towards and away from the conveyor 1, with the transported bales on it, on the same frame 4 on which the unit 2 with the carriage 8 is arranged.

Due to the design of the special tool 11, and the fact that the units 2 and 3, with respective carriage 8 and 19, with force can be pressed against the opposite side portions of the bale, it is possible for the tool 11 to function not only as a winding-up tool but also as a gripping tool, which catches hold of the metal wires in a secure way.

The second unit further comprises a discharging tool 20 comprising a round ring which is intended to be replaced hydraulically on the outside of and along the rod 12, whereby the bobbin, wound up on the rod, can be removed.

The second unit 3 can be provided with a further tool 21 having a strip 22 which is provided with teeth 23 and is suspended by articulated arms 24. The primary purpose of this tool is to enable the metal wires to be wound up evenly.

Figure 4:
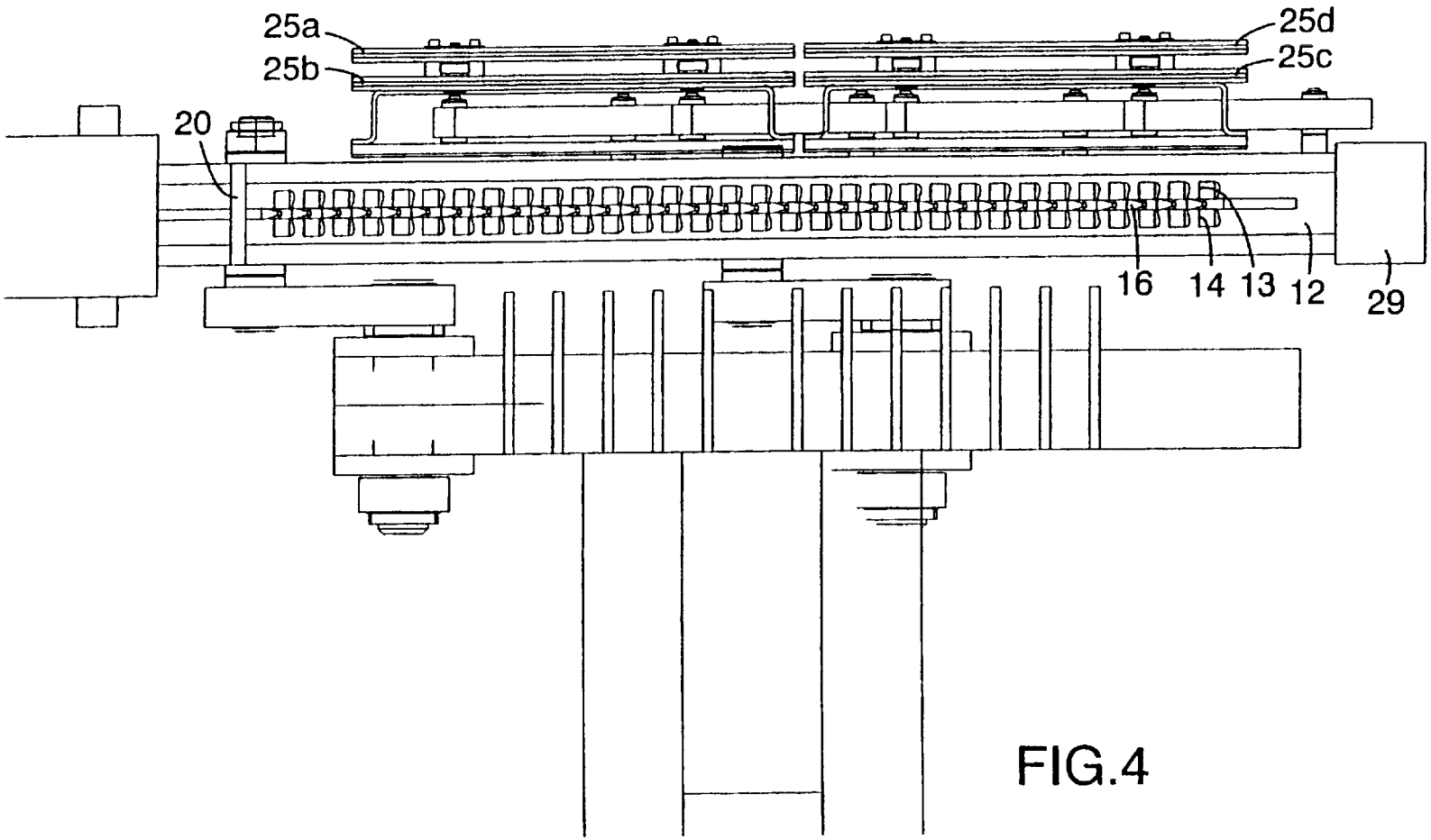
FIG. 4 is a top, elevational, enlarged, partially schematic view of another portion of the apparatus shown in FIG. 2.
Figure 5:
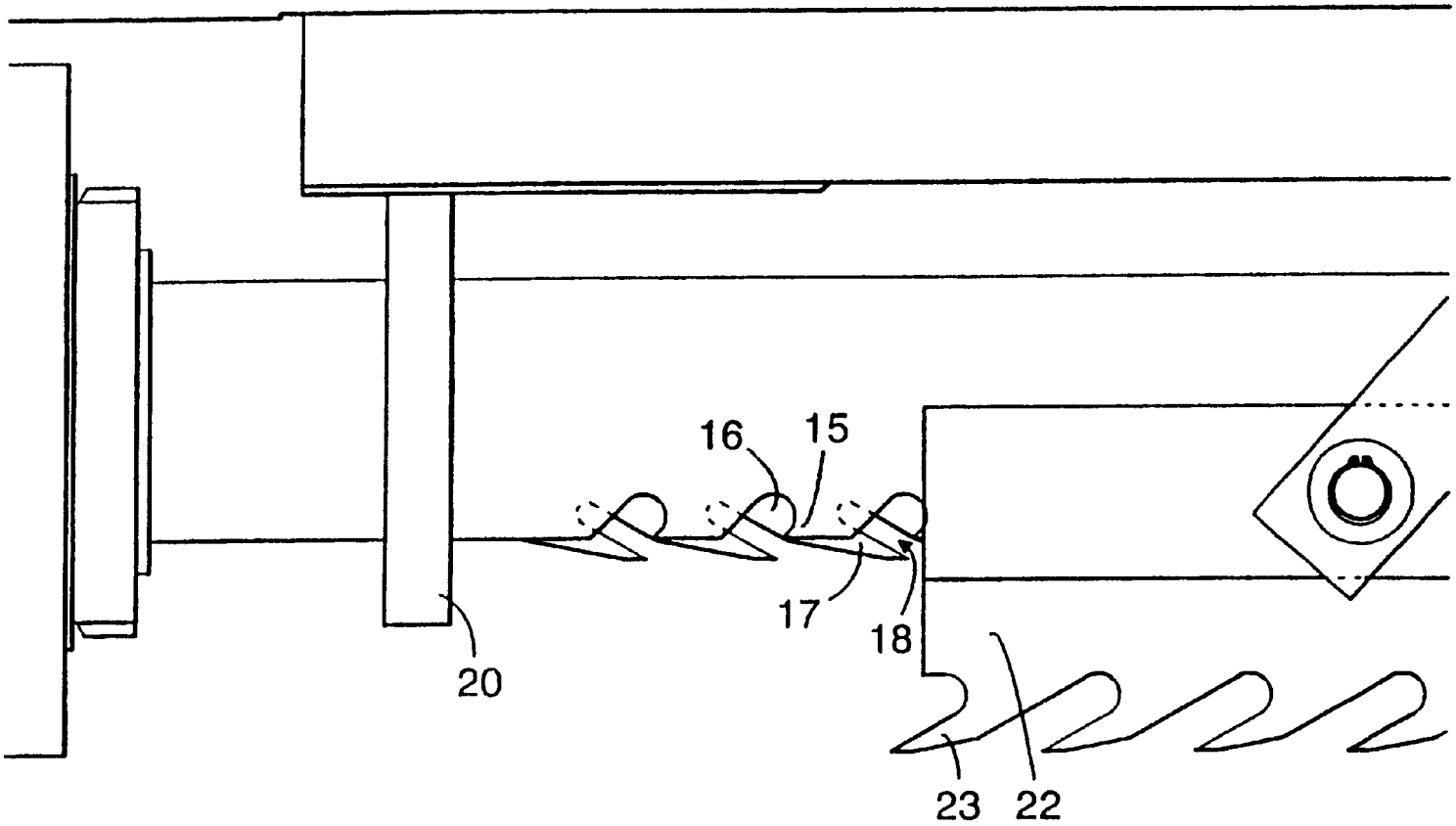
FIG. 5 is top, elevational, enlarged, schematic view of the teeth portion of the tool shown in FIG. 4.

As is apparent from FIG. 4, the second unit 3, according to this embodiment comprises four strips, 25*a–d,* parallel with the rod 12, all of which are made of a metallic material. These strips are intended to be in contact with the metal wires, and to give a signal when all of the wires have been wound up. In this manner, an effective removal of the metal wires is effected.

Figure 1:
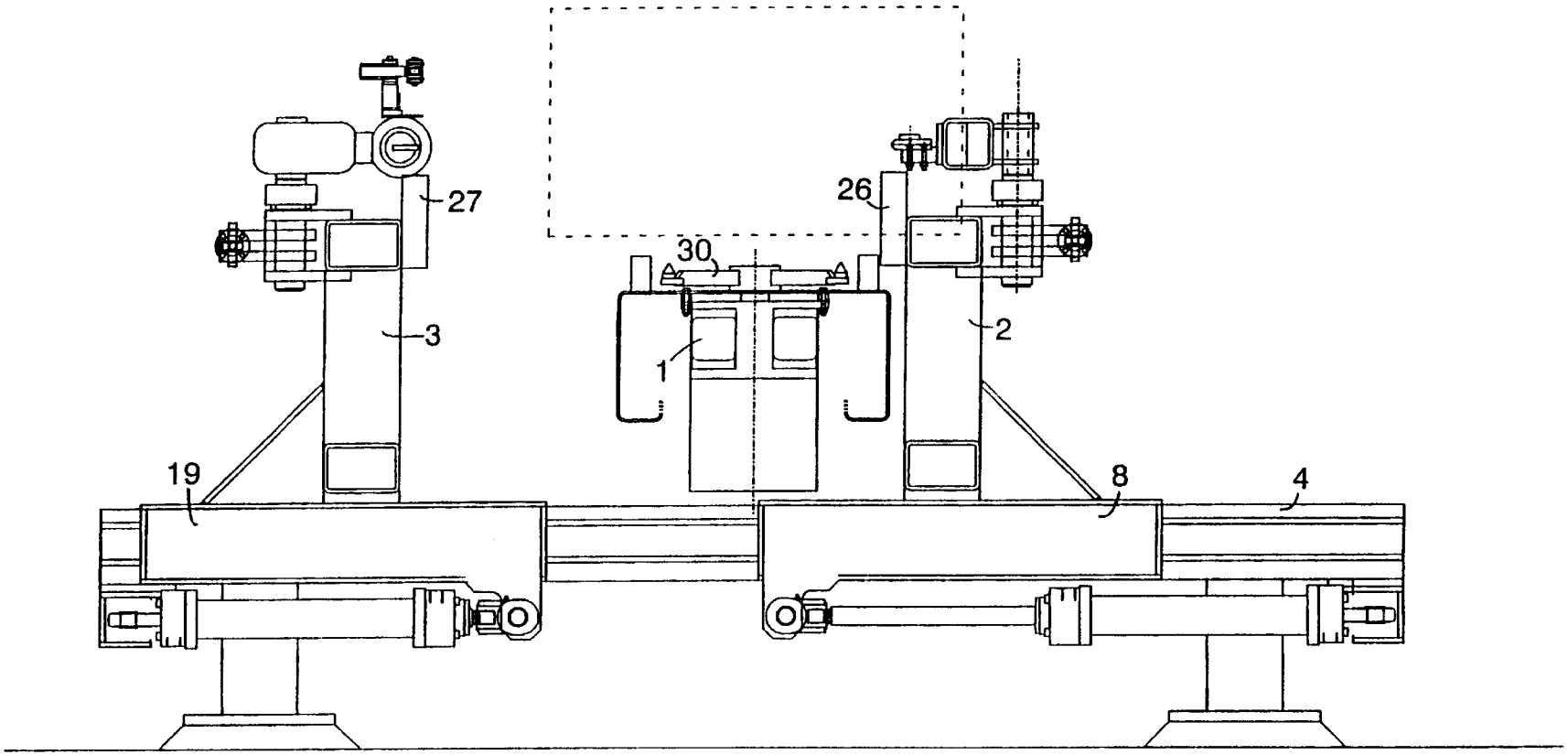
FIG. 1 is a side, elevational, partially schematic view of the dewiring apparatus of the present invention in conjunction with a conveyor.
Figure 2:
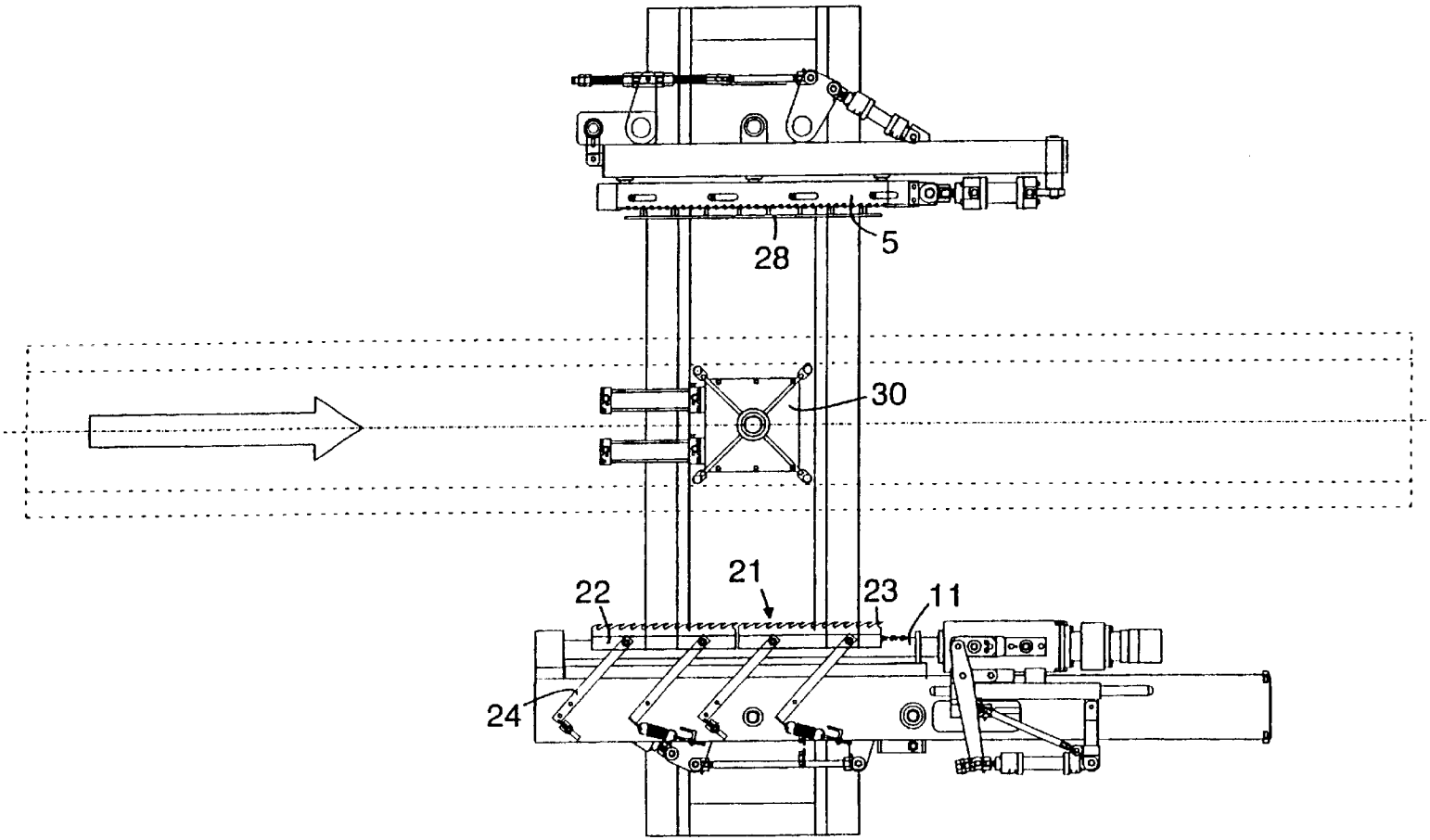
FIG. 2 is a top, elevational, partially schematic view of the apparatus shown in FIG. 1.

The de-wiring apparatus of the present invention functions in the following manner:

When the bale has reached the de-wiring apparatus, the conveyor 1 is stopped, whereafter the two carriages, 8 and 19, with the units, 2 and 3, begin to move towards the two opposite side surfaces of the bale. The flange-like front surfaces, 26 and 27, of the two units, 2 and 3, (see FIG. 1) are applied against the surfaces of the bale so that the bale is fixed by clamping between the units. Moreover, the first unit 2 has an essentially horizontal, plate-formed strip 28, which is intended to strengthen the bale if it should stand obliquely.

Thereafter the cutting tool 5 is applied against the bale side, the articulated arms, 9*a* and *b,* pressing the tool a short distance into the bale so that it is ensured that the tool reaches in behind the wires. In the next moment the cutting tool is activated, whereby the wires are cut off.

When the second unit 3 comes into contact with the opposite side of the bale, the combined gripping and winding tool 11 is pressed deeply into the bale side, at the same time as the tool moves to the right in FIG. 4 into a cavity formed by the means 29. In this manner, the metal wires get into the area between the teeth 15 and 17 of the tool 11.

In the next moment the rod 12 moves in relation to the strip 16 to the left in the illustration (see FIGS. 4 and 5), which causes the metal wires to be forced further into the tooth gaps 18 of the strip 16. At the same time the metal wires are fixed in the tooth gaps 18 by clamping of the teeth 15 of the rod 12.

Subsequently, the winding moment takes place and is carried out such that the rod 12 is forced into rotation, whereby the metal wires are wound around the rod and form bobbins thereon.

Next, the rod 12 is brought, in relation to the strip, to the right in the illustration (see FIG. 5), so that the tooth gap is opened. Thereafter, the rod 12 and the strip 16 are taken together to the left in the illustration (see FIG. 4), whereby there is created a gap (not shown) between the outer end of the rod 12 and the hollow means 29.

Finally, the last step relates to the removal of the bobbins from the rod 12. This is effected by a discharging tool 20, which is positioned at the rear end of the rod 12, and which is forced forwards along the rod and removes the bobbins therefrom, which bobbins fall down through the opening that has been formed at the means 29.

If the bale is also surrounded by metal wires on the two remaining, opposite and vertical side portions thereof, the carriages, 8 and 19, with the units, 2 and 3, are taken quickly from the bale, whereafter it is rotated a quarter of a revolution on the conveyor by the rotatable laying-up plate 30, whereafter the same procedure as discussed previously again takes place.

The present invention is, of course, not limited to the mentioned and shown embodiment but can be modified within the scope of the following claims. Thus, the winding tool could be composed of an outer, tubular means, which is intended to co-operate with an inner, concentric means, the teeth formed on these means being directed towards each other.

According to the described embodiment, the movements in the de-wiring apparatus are preferably made hydraulically. Of course, it is within the scope of the present invention for at least certain of these movements to be made in another manner, for instance either electrically and/or pneumatically.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for de-wiring bales having a pair of opposite sides tied by metal wires and moving along a conveyor in a first direction, said apparatus comprising a first movable unit movable in a direction substantially perpendicular to said first direction on one of said sides of said bales, said first movable unit including a cutting tool for cutting said metal wires on said one of said sides of said bales, a second movable unit movable in a direction substantially perpendicular to said first direction on said other of said sides of said bales, said second movable unit including a gripping and winding tool disposed substantially parallel with said conveyor for gripping said metal wires and winding said metal wires, said gripping and winding tool adapted to rotate in order to wind up said metal wires onto bobbins, said gripping and winding tool comprising a substantially cylindrical metal rod rotatably mounted on said second movable unit and including a front end, a rear end, a surface, and a longitudinal direction, said rod being rotatably mounted on said rear end of said rod, said rod further including a plurality of slots arranged in parallel on said surface of said rod essentially perpendicular to said longitudinal direction of said rod, a longitudinal recess substantially along the entire length of said rod through said plurality of slots, said longitudinal recess thereby providing a first plurality of teeth facing towards said rear end of said rod, and a metal strip disposed in said longitudinal recess and including a second plurality of teeth facing said forward end of said rod so as to be directed in a direction opposite to said first plurality of teeth, said first and second pluralities of teeth being displaceably mounted with respect to said longitudinal recess and being cooperable for gripping said metal wires therebetween, said second movable unit further comprising a discharging member movable at a location adjacent to said gripping and winding tool distal from said bales for removing said wire wound on said bobbins from said second movable tool.

2. Apparatus for de-wiring bales having a pair of opposite sides tied by metal wires and moving along a conveyor in a first direction, said apparatus comprising a first movable unit movable in a direction substantially perpendicular to said first direction on one of said sides of said bales, said first movable unit including a cutting tool for cutting said metal wires on said one of said sides of said bales, a second movable unit movable in a direction substantially perpendicular to said first direction on said other of said sides of said bales, said second movable unit including a gripping and winding tool disposed substantially parallel with said conveyor for gripping said metal wires and winding said metal wires, said gripping and winding tool adapted to rotate in order to wind up said metal wires onto bobbins, said gripping and winding tool comprising a first substantially cylindrical tubular member having a forward end, a rear end, a surface, an inner cavity, and a longitudinal direction, said first substantially cylindrical tubular member being rotatably mounted at said rear end of said first substantially cylindrical tubular member, said first substantially cylindrical tubular member further including a plurality of slots arranged in parallel on said surface of said first substantially cylindrical tubular member essentially perpendicular to said longitudinal direction, said plurality of slots penetrating into said inner cavity of said first substantially cylindrical tubular member, a longitudinal recess substantially along the entire length of said first substantially cylindrical tubular member through said plurality of slots, said longitudinal recess thereby providing a first plurality of teeth facing towards said rear end of said first substantially cylindrical tubular member and a second substantially cylindrical tubular member displaceably disposed within said first substantially cylindrical tubular member, said second substantially cylindrical tubular member including a strip extending along the entire length of said second substantially cylindrical tubular member, said strip adapted to be positioned in said longitudinal recess of said first substantially cylindrical tubular member, and including a second plurality of teeth facing said forward end of said first substantially cylindrical tubular member so as to be directed in a direction opposite to said first plurality of teeth, said first and second pluralities of teeth being cooperable for gripping said metal wires therebetween, said second movable unit further comprising a discharging member movable at a location adjacent to said gripping and winding tool distal from said bales for removing said wire wound on said bobbins from said second movable tool.

* * * * *